US009464240B2

(12) United States Patent
Bridges et al.

(10) Patent No.: US 9,464,240 B2
(45) Date of Patent: Oct. 11, 2016

(54) AROMATICS PRODUCTION PROCESS

(71) Applicants: Lyondell Chemical Technology, L.P., Houston, TX (US); Equistar Chemicals, LP, Houston, TX (US)

(72) Inventors: Robert S. Bridges, Friendswood, TX (US); Steven T. Coleman, Humble, TX (US)

(73) Assignees: Lyondell Chemical Technology, L.P., Houston, TX (US); Equistar Chemicals, LP, Houston, TX (US)

( * ) Notice: Subject to any disclaimer, the term of this patent is extended or adjusted under 35 U.S.C. 154(b) by 0 days.

(21) Appl. No.: 15/157,165

(22) Filed: May 17, 2016

(65) Prior Publication Data

US 2016/0257894 A1 Sep. 8, 2016

Related U.S. Application Data

(62) Division of application No. 13/759,739, filed on Feb. 5, 2013.

(51) Int. Cl.

| | |
|---|---|
| ***C07C 4/02*** | (2006.01) |
| ***C07C 4/06*** | (2006.01) |
| ***C07C 7/10*** | (2006.01) |
| ***C10G 55/02*** | (2006.01) |
| ***C10G 63/04*** | (2006.01) |

(52) U.S. Cl.
CPC ..... *C10G 63/04* (2013.01); *C10G 2400/02* (2013.01); *C10G 2400/30* (2013.01)

(58) Field of Classification Search
CPC ..... C07C 4/02; C07C 4/06; C07C 7/10; C10G 55/02
USPC ..... 585/319, 648, 833; 208/67, 69, 70
See application file for complete search history.

(56) References Cited

U.S. PATENT DOCUMENTS 3,787,314 A * 1/1974 Donaldson ..... C10G 47/14 208/60

* cited by examiner

*Primary Examiner* — Thuan D Dang

(57) ABSTRACT

Embodiments of the present disclosure include methods for producing aromatic products, the methods including separating a crude oil and condensate feed into at least a light naphtha stream, a heavy naphtha stream, and a bottoms stream, reforming at least a portion of the heavy naphtha stream to produce a reformate stream, feeding a cracker feed stream, comprising the light naphtha stream, the bottoms stream, and a reformate extraction raffinate, to an olefins cracker to produce cracker products comprising pyrolysis gasoline, and introducing an extractor feed stream comprising the pyrolysis gasoline and the reformate to an aromatic extraction unit to produce an aromatic product and the reformate extraction raffinate.

6 Claims, 2 Drawing Sheets

AROMATICS PRODUCTION PROCESS

CROSS-REFERENCE TO RELATED APPLICATION

This application is a divisional application of U.S. patent application Ser. No. 13/759,739, filed Feb. 5, 2013, the disclosure of which is incorporated herein by reference in its entirety.

BACKGROUND OF THE INVENTION

1. Field of the Invention

Embodiments disclosed herein relate to systems and methods for the production of aromatics. More specifically, embodiments disclosed herein relate to systems and methods for increasing the production of aromatics in crude cracking.

2. Background Art

This section introduces information from the art that may be related to or provide context for some aspects of the technique described herein and/or claimed below. This information is background facilitating a better understanding of that which is disclosed herein. This is a discussion of "related" art. That such art is related in no way implies that it is also "prior" art. The related art may or may not be prior art. The discussion is to be read in this light, and not as admissions of prior art.

Cracking of hydrocarbons is commonly used in the petrochemical industry to produce useful chemicals, such as ethylene, propylene, butenes, butadienes, and the like. Certain aromatics, such as benzene, toluene, and xylene may also be produced during the cracking of hydrocarbons.

Hydrocarbon sources that may be used in the production of such useful chemicals may include, for example, crude oils and natural gas. Both crude oil and natural gas are recovered by drilling wellbores into hydrocarbon containing formations. The oil and/or gas are then extracted/produced from the wellbore. The produced crude oil and/or gas may then be piped to a refinery or piped to a storage facility.

During the refining of crude oil, the oil is conventionally transferred to a refinery, wherein the oil is distilled into separate components. The individual components may then be further refined to convert the components into desired products. The conversion and separation of the individual components may involve, for example, thermal cracking, catalytic cracking, reforming, isomerization, alkylation, hydrogen treatment, compression, extraction, etc.

During the production of olefins, the refining of oil into ethylene, propylene, butenes, butadienes, and the like often results in the under production of certain valuable aromatics, such as benzene, toluene, and xylene.

Accordingly, there exists a continuing need for systems and methods for increasing the production of aromatics from crude oil. The presently disclosed technique is directed to resolving, or at least reducing, one or all of the problems mentioned above. Furthermore, the art is always receptive to improvements or alternative means, methods and configurations.

SUMMARY OF THE INVENTION

In one aspect, embodiments disclosed herein relate to methods of producing aromatic products, the methods including separating a crude oil and condensate feed into at least a light naphtha stream, a heavy naphtha stream, and a bottoms stream and reforming at least a portion of the heavy naphtha stream to produce a reformate stream. The methods further include feeding a cracker feed stream, comprising the light naphtha stream, the bottoms stream, and a reformate extraction raffinate, to an olefins cracker to produce cracker products comprising pyrolysis gasoline, and introducing an extractor feed stream comprising the pyrolysis gasoline and the reformate to an aromatic extraction unit to produce an aromatic product and the reformate extraction raffinate.

In another aspect, embodiments disclosed herein relate to systems including a hydrocarbon separator, a cracker in fluid communication with the hydrocarbon separator, wherein the hydrocarbon separator is configured to provide a light naphtha stream and a bottoms stream to the cracker, and a gasoline reformer in fluid communication with the hydrocarbon separator and the cracker.

In another aspect, embodiments disclosed herein relate to methods of producing aromatic products, the methods including separating a crude oil and condensate feed into at least a light naphtha stream, a heavy naphtha stream, and a bottoms stream and feeding a cracker feed stream, comprising the light naphtha stream and the bottoms stream, to an olefins cracker to produce cracker products. The methods further include extracting the aromatic products from at least a portion of the cracker products to produce a first aromatic product stream and an aromatics extraction raffinate stream, and reforming at least a portion of the aromatics extraction raffinate stream and the heavy naphtha stream to produce a reformate stream. The methods also include extracting additional aromatic products from the reformate stream to produce a second aromatic product stream and a second aromatic extraction raffinate stream, wherein the cracker feed stream further comprises the second aromatic extraction raffinate stream.

The above presents a simplified summary of the present disclosure to provide a basic understanding of some aspects of the disclosure. This summary is not an exhaustive overview of the disclosure. It is not intended to identify key or critical elements or to delineate the scope of the disclosure. Its sole purpose is to present some concepts in a simplified form as a prelude to the more detailed description that is discussed later.

BRIEF DESCRIPTION OF DRAWINGS

The claimed subject matter may be understood by reference to the following description taken in conjunction with the accompanying drawings, in which like reference numerals identify like elements, and in which:

While the subject matter claimed below is susceptible to various modifications and alternative forms, the drawings illustrate specific embodiments herein described in detail by way of example. It should be understood, however, that the description herein of specific embodiments is not intended to limit the disclosure to the particular forms disclosed, but on the contrary, the intention is to cover all modifications, equivalents, and alternatives falling within the spirit and scope of the disclosure as defined by the appended claims.

DETAILED DESCRIPTION

One or more specific embodiments of the present disclosure will be described below. The present disclosure is not limited to the embodiments and illustrations contained herein, but include modified forms of those embodiments including portions of the embodiments and combinations of elements of different embodiments as come within the scope of the appended claims. In the development of any such actual implementation, as in any engineering or design project, numerous implementation-specific decisions must be made to achieve the developers' specific goals, such as compliance with system related and business related constraints, which may vary from one implementation to another. Moreover, such a development effort might be complex and time consuming, but would nevertheless be a routine undertaking of design, fabrication, and manufacture for those of ordinary skill having the benefit of this disclosure.

In one aspect, embodiments disclosed herein relate to systems and methods for the production of aromatics. In another aspect, embodiments disclosed herein relate to systems and methods for increasing the production of aromatics in crude cracking.

Figure 1:
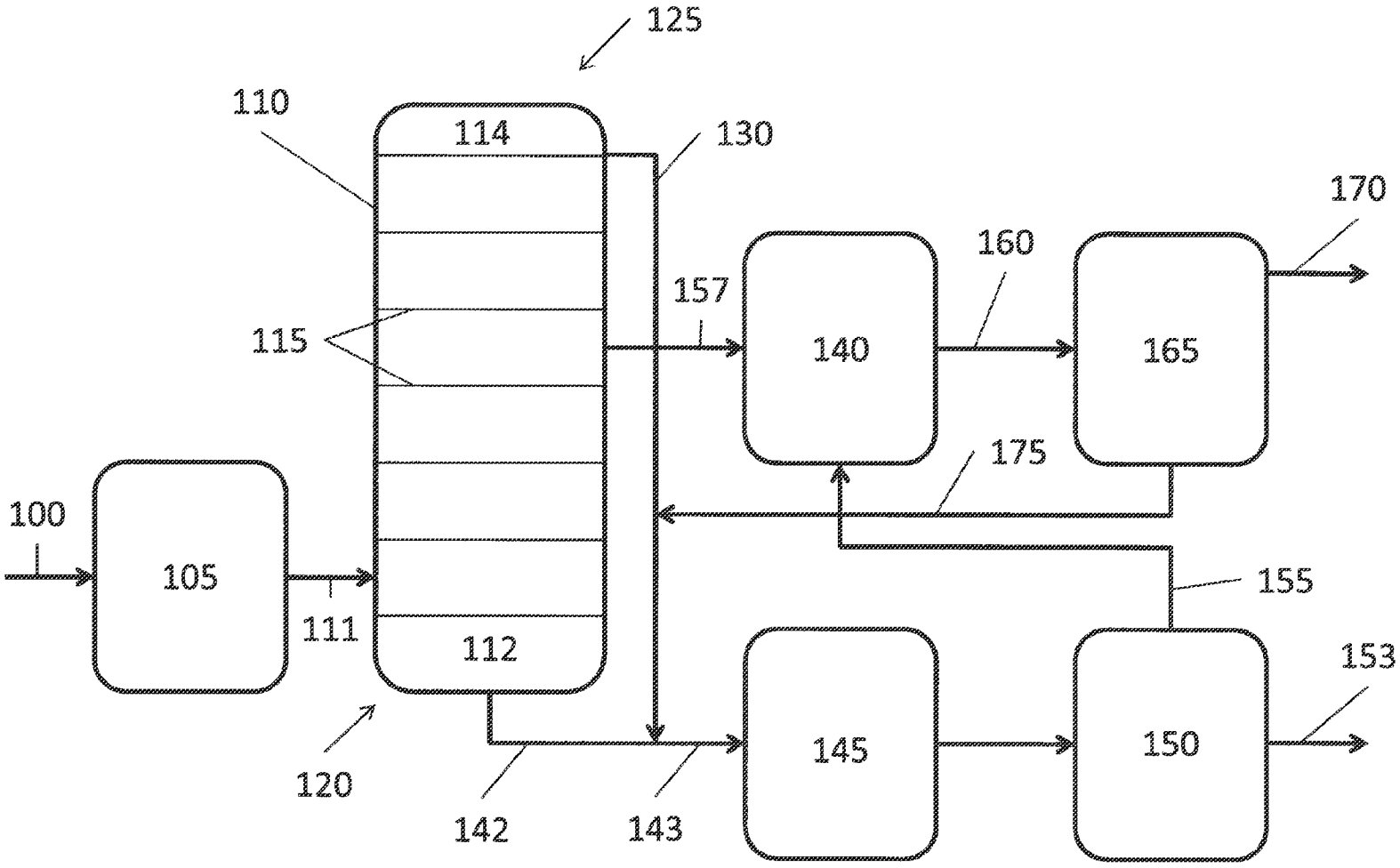
FIG. 1 is a flow diagram of a crude cracking process according to one embodiment of the present disclosure.

Referring to FIG. 1, a flow diagram of a crude cracking process according to one embodiment of the present disclosure is shown. In this embodiment, a stream comprising crude oil and condensate 100 is fed into a feed furnace 105 to pre-heat the crude oil. The crude oil may also be partially vaporized in feed furnace 105.

After pre-heating, a pre-heated crude oil stream 111 is transferred to an atmospheric distillation unit 110. The atmospheric distillation unit 110 may include a re-boiler 112 and a condenser 114. The atmospheric distillation unit 110 is configured to separate off various components of the crude oil, such as, for example, gasoline, naphtha, kerosene, gas oil, and bottoms. The pressure profile in the atmospheric distillation unit 110 resembles atmospheric pressure, with the highest pressure at the bottom 120, and the pressure gradually decreasing to the top 125. The pressures within the atmospheric distillation unit 100 may range between, for example, 25-75 psi, and in certain embodiments the pressures may range between 35-50 psi. The temperature in the atmospheric distillation unit 110 is highest at the bottom 120 and lowest at the top 125. For example, the temperature in the atmospheric distillation unit 110 may range between about 100° F. and about 150° F. at the top 125 and between about 550° F. and about 750° F. at the bottom 120.

In certain embodiments, atmospheric distillation unit 110 may include a plurality of fractionation trays 115 (only two are indicated in FIG. 1). Depending on the requirements of the atmospheric distillation unit 110, such as the products that are to be separated from the pre-heated crude oil stream 111, the number of fractionation trays 115 may vary. In one embodiment, the number of trays may vary between, for example, 8 and 20 trays. Those of ordinary skill in the art having the benefit of this disclosure will appreciate that greater or fewer fractionation trays 115 may be used depending on the products being separated. As hydrocarbons are vaporized at the bottom 120 of the atmospheric distillation unit 110, the vaporized hydrocarbons move upward within the atmospheric distillation unit 110. The heat at the top 125 of the atmospheric distillation unit 110 is lower because the heat may be absorbed by the condenser 114, which is configured to condense a portion of the vaporized hydrocarbons. The condensed hydrocarbons may then flow down through the fractionation trays 115.

The re-boiler 112, condenser 114, and fractionation trays 115 create a plurality of temperature and pressure gradients through the atmospheric distillation unit 110. The temperature and pressure gradients at each fractionation tray 115 allow for particular products to be collected at each fractionation tray 115. The heavier hydrocarbons may be separated at the bottom 120 of the atmospheric distillation unit 110, while the lighter hydrocarbons may be separated at the top 125 of the atmospheric distillation unit 110.

In one embodiment, crude oil is fractionated within the atmospheric distillation unit 110 to produce a light naphtha stream 130, a heavy naphtha stream 157, and a bottoms stream 142. Those of ordinary skill in the art will appreciate that numerous other hydrocarbons may be fractionated, such as, for example, kerosene, diesel, gas oil, etc. The light naphtha may include hydrocarbons having a boiling point of less than 70° C., while the heavy naphtha may include hydrocarbons having a boiling point between about 70° C. and 18520 C. The bottoms stream may include hydrocarbons having a boiling point of greater than 18520 C.

The light naphtha stream 130 may be collected near the top 125 of atmospheric distillation unit 110, while the bottoms stream 142 may be collected near the bottom 120 of atmospheric distillation unit 110. The light naphtha stream 130 may then be transferred and recombined with the bottoms stream 142 to form an olefin unit feed stream 143. The processing of the heavy naphtha stream 157 will be discussed in greater detail below. Additionally, in certain embodiments, the initial separation in the atmospheric distillation unit 110 may be avoided by directly feeding crude oil 100 to a pyrolysis furnace, which is also described below.

As stated above, light naphtha and bottoms streams 130 and 142 may be combined to form olefin unit feed stream 143, which is fed to an olefin processing unit 145. The olefin processing unit 145 may include any number of various components that are configured to separate products from a feed hydrocarbon, such as crude oil 100 or the combined light naphtha and bottoms stream 143. For example, olefins processing unit 145 may produce various petrochemical compounds such as, ethylene, propylene, vinyl chloride monomer, polyethylene, polypropylene, butadiene, styrene monomer, poly styrene, poly vinyl chloride, xylene, and the like.

Olefin processing unit 145 may employ various steps in the production of the petrochemical compounds described above. Generally, olefin processing unit 145 employs the steps of thermally cracking the hydrocarbon feed in the presence of steam at high temperatures and in a relatively short time. The cracking process is then terminated by quenching the cracking effluents. Cracking processes suitable for implementation in the olefin processing unit 145 are well known to the art. Exemplary cracking processes are disclosed in, for example, U.S. Pat. Nos. 7,404,889 and 6,303,842, both hereby incorporated by reference. However, any suitable cracking process known to the art may be used. The cracked gaseous hydrocarbons are then compressed to a high pressure to remove acidic gases. Individual products may then be removed from the gaseous hydrocarbons through processes of liquefaction and fractionation. The individual products may then be purified.

In one embodiment, olefin processing unit 145 includes a furnace (not independently shown). In one embodiment, the furnace may be a pyrolysis furnace (not shown), e.g., a steam cracker. Generally, a pyrolysis furnace includes a series of tubular coils made from, for example, chromium and nickel alloys. The tubular coils are disposed in a furnace body having a heat source. Depending on the design parameters of the pyrolysis furnace, the number of tubular coils, as well as the design of the tubular coils, may vary. In certain embodiments, between 10 and 150 tubular coils may be used. In alternative embodiments, even greater numbers of tubular coils may be used. Various types of tubular coils may be used. Examples of the types of tubes that may be used include single-pass coils, two-pass or U-coils, four-pass or W-coils, and hybrid coils having multiple inlets that feed to a single termination coil.

The heat source of the pyrolysis furnace may include a plurality of burners arranged on the walls and base of the furnace, thereby allowing indirect firing. The portion of the pyrolysis furnace having the burners and coils is referred to as the radiant section of the furnace. Pyrolysis furnaces may also have a convection section that allow for pre-heating of a feed hydrocarbon source prior to introduction into the radiant section of the furnace.

The combined light naphtha and bottoms stream 143 may be transferred to the convection section of a pyrolysis furnace. In the convection section, the hydrocarbons are pre-heated to, for example, about 350° F. at about 60 psig, although the temperatures may range from 250° F. to 450° F. and the pressures may range from 30 to 100 psig. The hydrocarbons may then be passed to a vaporization unit of the pyrolysis furnace wherein a mixture of gasoline and certain naphtha gases are separated to form distillate liquids. The separated gases are then transferred to the radiant section of the furnace where they are exposed to high heat. In one embodiment, the radiant section of the furnace my expose the gases to temperatures in the range of about 1450° F. to about 1550° F.

The olefin processing unit 145 may also have a quench cooling system. Rapid cooling of the hydrocarbons may be useful to prevent the loss of valuable products. The cooling in a quench cooling system may be accomplished by cooling the hydrocarbons through direct and/or indirect methods. After the hydrocarbon gas passes through the furnace, the gas is transferred through, for example, a transfer line exchanger and may be cooled through the use of quench oil. Quench oil is typically a mixture of heavy hydrocarbons, such as in the range of $C_{12}$ and heavier, and is often referred to as pyrolysis fuel oil or pyrolysis gas oil. The hydrocarbon gas/quench oil mixture may then be transferred to a quench tower. In the quench tower, the mixture of hydrocarbons may be contacted with a lighter liquid quench material, such as one containing hydrocarbons in the range of $C_5$ to $C_{12}$, which may be referred to as pyrolysis gas. The pyrolysis gas may be directly added to further cool the cracked hydrocarbons, as well as to condense and recover fuel oil.

The cracked hydrocarbons may then be removed from the quench tower (not shown) and transferred to a water quench tower (also not shown), where the cracked hydrocarbons are contacted by cooled water. The water may be vaporized through contact with the hot hydrocarbon gases to condense heavier hydrocarbons. The water may thus condense liquid pyrolysis gasoline, which may then be removed and used in other processes. The processed cracked hydrocarbons may then be removed from the quench water tower to be processed in compression and fractionation portions of the olefin processing unit 145.

Those ordinarily skilled in the art having the benefit of this disclosure will appreciate that, in addition to the direct cooling of the cracked hydrocarbons, the hydrocarbons may be cooled through the use of indirect methods, for example, heat exchangers, to further cool the gases. Such indirect methods may include transfer line heat exchangers, wherein heat is recovered to generate high pressure steam. Depending on the products being produced, the hydrocarbons may be cooled through the use of transfer line heat exchangers followed by the use of oil and/or water quench towers, as discussed above. The specific methods used will depend on a number of variables including, for example, the composition of the feedstock hydrocarbons, the conditions within the olefins cracker, the heat applied, etc.

In one embodiment, the compression and fractionation portion of olefin processing unit 145 separates hydrogen, ethylene, propylene, crude $C_4$s, pyrolysis gasoline, pyrolysis fuel oil, and residual fuel oil. Olefin processing unit 145 may also produce aromatics which are fed to a benzene and toluene extractor 150. The benzene and toluene extractor 150 may use one of several processes for removing benzene and toluene that are known in the art. For example, in certain embodiments, extractor 150 may use a process known in the art as the sulfolane process, which uses sulfolane as the solvent. In alternate embodiments, the extractor 150 may use the UDEX process, also known in the art, which uses dipropylene glycol or triethylene glycol as the solvent. In certain embodiments, other comparable liquid-liquid distillations or extractive distillations may be used to effect the same separation. The benzene and toluene may then be separated through distillation. As benzene and toluene product stream 153 exits extractor 150, a raffinate stream 155, which may be highly naphthenic, for example, including between 50% and 75% naphthenes, may be transferred to gasoline reformer 140.

The extractor raffinate stream 155 may be combined with the heavy naphtha stream 157, transferred from atmospheric distillation unit 110, in gasoline reformer 140. In an alternative embodiment (not shown), the extractor raffinate stream 155 may be combined with the heavy naphtha stream 157 prior to introduction into the gasoline reformer 140. The heavy naphtha stream 157, prior to mixing with the extractor raffinate stream 155, may contain a large amount of aromatics and naphthenes, for example, ranging between 25% and 50% of the total volume. The gasoline reformer 140 is configured to convert the naphthenes introduced from the extractor raffinate stream 155 and the heavy naphtha stream 157 to aromatics.

The reformate stream 160 from gasoline reformer 140 may then be transferred to an aromatics extractor 165. The aromatics extractor 165 is configured to generate an aromatic product by separating out specific aromatic compounds, such as benzene, toluene, and xylene, and to form aromatic stream 170. Aromatic stream 170 may then be transferred to storage and/or otherwise subjected to further processing (not shown).

During the extraction of the aromatic compounds, a reformate raffinate extractor stream 175 from the aromatics extractor 165 remains. The reformate raffinate extractor stream 175 from the aromatics extractor 165 is highly paraffinic. As highly paraffinic materials are beneficial in olefin cracking, the reformate raffinate extractor stream 175 from the aromatics extractor 165 is transferred and combined with the light naphtha stream 130 and the bottom stream 142 from the atmospheric distillation unit 110. In certain embodiments, the reformate raffinate extractor stream 175 may be combined with light naphtha stream 130 before combining with bottom stream 142 to form olefin unit feed stream 143. In alternate embodiments, the reformate raffinate extractor stream 175 may be combined with the bottom stream 142 and then combined with the light naphtha stream 130 to form olefin unit feed stream 143. In still other embodiments, the reformate raffinate extractor stream 175, the light naphtha stream 130, and the bottom stream 142 may be combined collectively to form olefin unit feed stream 143. This combination of the reformate raffinate extractor stream 175 from the aromatics extractor 165, the light naphtha stream 130, and the bottom stream 142 may then be transferred to the olefin processing unit 145, and processed, as described above.

Figure 2:
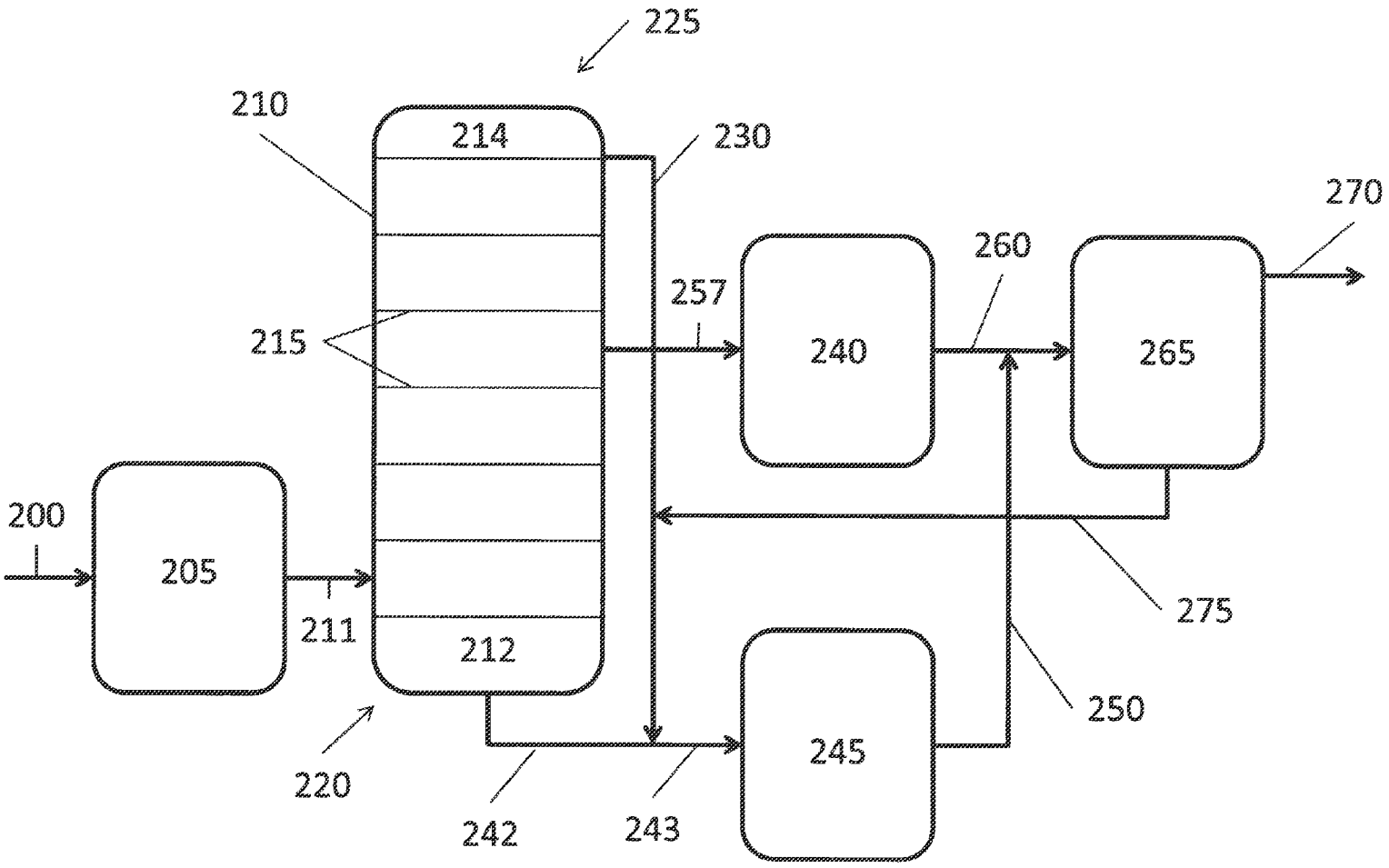
FIG. 2 is a flow diagram of a crude cracking process according to an alternative embodiment of the present disclosure.

Referring to FIG. 2, a flow diagram of a crude cracking process according to an alternative embodiment of the present disclosure is shown. In this embodiment, a stream comprising crude oil and condensate 200 is fed into a feed furnace 205 to pre-heat the crude oil. The crude oil may also be partially vaporized in feed furnace 205.

After pre-heating, the pre-heated crude oil stream 211 is transferred to an atmospheric distillation unit 210. The atmospheric distillation unit 210 may include a re-boiler 212 and a condenser 214. In certain embodiments, atmospheric distillation unit 210 may include a plurality of fractionation trays 215 (only two are indicated). Depending on the requirements of the atmospheric distillation unit 210, such as the products that are to be separated from the pre-heated crude oil stream 211, the number of fractionation trays 215 may vary, as described above with respect to FIG. 1. As hydrocarbons are vaporized at the bottom 220 of the atmospheric distillation unit 210, the vaporized hydrocarbons move upward within the atmospheric distillation unit 210. The heat at the top 225 of the atmospheric distillation unit 210 is lower because the heat may be absorbed by the condenser 214, which is configured to condense a portion of the vaporized hydrocarbons. The condensed hydrocarbons may then flow down through the fractionation trays 215.

In one embodiment, pre-heated crude oil stream 211 is fractionated within the atmospheric distillation unit 210 to produce alight naphtha stream 230, a heavy naphtha stream 257, and a bottoms stream 242. In certain embodiments, pre-heating the crude oil may not be necessary, and as such, crude oil may be fed directly into atmospheric distillation unit 210. The light naphtha stream 230 may be collected near the top 225 of atmospheric distillation unit 210, while the bottoms stream 242 may be collected near the bottom 220 of atmospheric distillation unit 210. The light naphtha stream 230 may then be transferred and recombined with the bottom stream 242. The processing of the heavy naphtha stream 257 will be discussed in greater detail below.

The light naphtha stream 230 and the bottoms stream 242 may be combined to form feed stream 243, which is fed to an olefin processing unit 245. The olefin processing unit 245 operates similarly to olefin processing unit 145 discussed with respect to FIG. 1, producing/separating hydrogen, ethylene, propylene, crude C4s, pyrolysis gasoline, pyrolysis fuel oil, and residual fuel oil. During the extraction of the above referenced products, pyrolysis gasoline streams containing benzene and toluene 250 may also be produced. The pyrolysis gasoline stream 250 may then be transferred to an aromatics extractor 265, which will be described below.

As explained above with respect to FIG. 1, a heavy naphtha stream 257 from atmospheric distillation unit 210 may be transferred to gasoline reformer 240. The gasoline reformer 240 is configured to reform the heavy naphtha to useful high-octane products.

The reformate stream 260 from gasoline reformer 240 may then be transferred to aromatics extractor 265. The aromatics extractor 265 is configured to separate out specific compounds, such as benzene, toluene, and xylene. The extracted benzene, toluene, and xylene 270 then be transferred to storage and/or otherwise subjected to further processing (not shown).

During the extraction of the aromatic compounds, a raffinate stream 275 is formed in the aromatics extractor 265. The raffinate stream 275 may be highly paraffinic. As highly paraffinic materials are beneficial in olefin cracking, the raffinate stream 275 is transferred and combined with the light naphtha stream 230 (shown) or with the combined light naphtha and bottom streams (not shown) from the atmospheric distillation unit 210. This combination of raffinate stream from the aromatics extractor 265, light naphtha, and bottom stream may then be transferred to the olefin processing unit 245, and processed, as described above.

The systems described above may be implemented to increase the production of aromatics from crude oil. In one method of producing aromatic products, a hydrocarbon feed, such as crude oil and condensate, is separated into at least a light naphtha stream, a heavy naphtha stream, and a bottoms stream. Those of ordinary skill in the art will appreciate that additional streams may also be separated out at the same time as the light naphtha stream, the heavy naphtha stream, and the bottom stream. The hydrocarbon feed may also include pre-separated portions of light naphtha, as well as a bottoms portion that may be recovered from a hydrocarbon separator, which is explained further below. In certain embodiments, separating the hydrocarbon feed may occur in an atmospheric distillation unit, as described above, while in other embodiments, the hydrocarbon feed may be separated through use of a pyrolysis furnace.

A cracker feed stream that includes the light naphtha stream and the bottoms stream may then be fed to an olefins crackers to produce cracker products, such as pyrolysis gasoline. After extracting the pyrolysis gasoline, the pyrolysis gasoline may be introduced as an extractor feed stream to an aromatic extraction unit.

Additionally, a portion of the heavy naphtha stream may be introduced to a gasoline reformer to produce a reformate stream. In certain embodiments, the reformate stream may be mixed with the pyrolysis gasoline prior to introduction into the aromatic extraction unit to form the extractor feed stream. In alternative embodiments, both the reformate stream and the pyrolysis gasoline may be introduced into the aromatic extractor unit independently to form the extractor feed stream. The aromatic extractor unit may thus process the extractor feed stream to produce an aromatic product and an extraction raffinate. The aromatic products may include, for example, benzene, toluene, and xylene.

As the extraction raffinate is highly paraffinic, the extraction raffinate may be introduced as a cracker feed stream to the olefins cracker. In certain embodiments, the extraction raffinate may be mixed with the light naphtha stream and the bottoms stream and fed to the olefins crackers as the cracker feed stream. In alternative embodiments, the extraction raffinate may be introduced to the olefins cracker independently, along with the light naphtha stream and the bottom stream, as the cracker feed stream.

In an alternative embodiment, a hydrocarbon feed such as crude oil is separated into at least a light naphtha stream, a heavy naphtha stream, and a bottoms stream. Those of ordinary skill in the art will appreciate that additional streams may also be separated out at the same time as the light naphtha stream, the heavy naphtha stream, and the bottom stream. The hydrocarbon feed may also include pre-separated portions of light naphtha, as well as a bottoms portion that may be recovered from a hydrocarbon separator, which is explained further below. In certain embodiments, separating the hydrocarbon feed may occur in an atmospheric distillation unit, as described above, while in other embodiments, the hydrocarbon feed may be separated through use of a pyrolysis furnace.

A cracker feed stream that includes the light naphtha stream and the bottoms stream may then be fed to an olefins crackers to produce cracker products. Certain aromatic products may be extracted from at least a portion of the cracker products to produce a first aromatic product stream and an aromatics extraction raffinate stream. The aromatic products may include, for example, benzene and toluene.

Additionally, a portion of the heavy naphtha stream may be introduced to a gasoline reformer to produce a reformate stream. The aromatics extraction raffinate stream may be mixed with the heavy naphtha stream prior to introduction into a reformer, or alternatively, each stream may be introduced into the reformer independently and reformed to produce the reformate stream.

The reformate stream may then be transferred to an aromatics extractor so that additional aromatic products (i.e., a second aromatic product stream) are extracted from the reformate stream. The additional aromatic products may include, for example, benzene, toluene, and xylene. During the extraction of the additional aromatic products, the extraction also produces a second aromatic extraction raffinate stream.

The second aromatic extraction raffinate stream may then be fed to the olefins cracker as part of the cracker feed stream. In certain embodiments, the extraction raffinate may be mixed with the light naphtha stream and the bottoms stream and fed to the olefins cracker as the cracker feed stream. In alternative embodiments, the extraction raffinate may be introduced to the olefins cracker independently, along with the light naphtha stream and the bottom stream, as the cracker feed stream.

Advantageously, some embodiments of the present disclosure may provide more efficient systems and methods for the production of aromatics from crude oil. More specifically, the systems and methods disclosed herein may allow for the more efficient production of benzene, toluene and xylene from crude oil stocks.

Additional embodiments of the present disclosure may provide increased production of aromatics from crude oil. More specifically, the systems and methods disclosed herein may allow for increased production from benzene, toluene, and xylene due to recycling a raffinate stream from an aromatic extractor into an olefin production process.

Advantageously, some embodiments of the present disclosure may provide increased production of aromatics from crude oil stocks due to using pyrolysis gasoline produced in the olefin production process as a feed for an aromatics extractor.

Also advantageously, some embodiments of the present disclosure may provide increased production of aromatics from crude oil stocks due to recycling the raffinate from the benzene and toluene extraction as a feed for a gasoline reformer.

While the present disclosure has been described with respect to a limited number of embodiments, those skilled in the art, having benefit of this disclosure, will appreciate that other embodiments may be devised which do not depart from the scope of the disclosure as described herein.

What is claimed is:

1. A method of producing aromatic products, the method comprising:

separating a crude oil and condensate feed into at least a light naphtha stream, a heavy naphtha stream, and a bottoms stream;

feeding a cracker feed stream, comprising the light naphtha stream and the bottoms stream, to an olefins cracker to produce cracker products;

extracting the aromatics products from at least a portion of the cracker products to produce a first aromatic product stream and an aromatics extraction raffinate stream;

reforming at least a portion of the aromatics extraction raffinate stream and the heavy naphtha stream to produce a reformate stream; and extracting additional aromatic products from the reformate stream to produce a second aromatic product stream and a second aromatic extraction raffinate stream;

wherein the cracker feed stream further comprises the second aromatic extraction raffinate stream.

2. The method of claim 1, wherein the aromatic products and the additional aromatic products comprise at least one selected from the group consisting of benzene, toluene, and xylene.

3. The method of claim 1, wherein the separating the crude oil and condensate feed comprises separating the crude oil and condensate feed in an atmospheric distillation unit.

4. The method of claim 1, wherein the separating the crude oil and condensate feed comprises separating the crude oil and condensate feed in a pyrolysis furnace.

5. The method of claim 1, wherein the second aromatic extraction raffinate stream is mixed with the light naphtha stream and the bottoms stream.

6. The method of claim 1, further comprising mixing the first aromatics extraction stream with the heavy naphtha stream.

* * * * *